US006513707B1

(12) United States Patent
Haglöf

(10) Patent No.: US 6,513,707 B1
(45) Date of Patent: Feb. 4, 2003

(54) HAND-CARRIED COUNTING DEVICE

(75) Inventor: Stefan Haglöf, Helgum (SE)

(73) Assignee: Ingenjörsfirma I Haglöf AB, Långsele (SE)

( * ) Notice: Subject to any disclaimer, the term of this patent is extended or adjusted under 35 U.S.C. 154(b) by 0 days.

(21) Appl. No.: 09/529,857

(22) PCT Filed: Oct. 20, 1998

(86) PCT No.: PCT/SE98/01882

§ 371 (c)(1),
(2), (4) Date: Apr. 19, 2000

(87) PCT Pub. No.: WO99/23607

PCT Pub. Date: May 14, 1999

(30) Foreign Application Priority Data

Oct. 20, 1997 (SE) ..... 9703818

(51) Int. Cl.[7] ..... G06C 29/00
(52) U.S. Cl. ..... 235/59 R; 235/59 A
(58) Field of Search ..... 235/59 R, 51 R, 235/58 R, 59 A; 377/5; 340/323 R; 708/111; 368/21, 188; 713/500; 455/418; 379/354

(56) References Cited

U.S. PATENT DOCUMENTS 3,934,123 A 1/1976 Maurer et al. ..... 235/92 PD
4,041,295 A * 8/1977 Ido et al. ..... 708/111
4,059,955 A * 11/1977 Prak ..... 368/188
4,071,891 A * 1/1978 Barrows ..... 436/66
4,093,992 A * 6/1978 Kawamura et al. ..... 708/111
4,280,207 A * 7/1981 Maezawa ..... 368/21
4,396,828 A 8/1983 Dino et al. ..... 377/6
4,825,464 A * 4/1989 Wen ..... 379/354
5,084,695 A * 1/1992 Freeman ..... 340/323 R
5,574,895 A * 11/1996 Lee et al. ..... 713/500
5,898,751 A * 4/1999 Yakoby et al. ..... 377/5
5,930,703 A * 7/1999 Cairns ..... 455/418

OTHER PUBLICATIONS

Fukawa, Masahiko, Keyboard Controller, Apr. 2, 1992, translation of the abstract to JP 404100139 A.*

* cited by examiner

*Primary Examiner*—Michael G. Lee
*Assistant Examiner*—Jared J. Fureman
(74) *Attorney, Agent, or Firm*—Alfred J. Mangels

(57) ABSTRACT

A hand-carried counting device with which a counter is stepped forwards through one increment in response to the depression of a count key. The counting device is electronic and includes at least three different count keys for counting the numbers of three mutually different objects. Depressing a count key causes an electric signal to be sent to a register associated with a microprocessor, or the like, within the device. The register corresponds with the key that has been depressed. The device includes a function key which when depressed once or repeatedly causes the microprocessor to perform at least the function that causes the current count values in the various registers to be shown on a display carried by the device. At least one count key is operatively coupled with each of two count registers that are not coupled with another count key.

7 Claims, 1 Drawing Sheet

HAND-CARRIED COUNTING DEVICE

BACKGROUND OF THE INVENTION

1. Field of the Invention

The present invention relates to a counting device of the kind used for instance in taking forest inventories, where the counter is stepped forwards each time a count button or key is pressed. A forest inventory may comprise counting the number of trees present, the number of seed trees present, etc.

2. Description of the Related Art

Such counting devices are also used in diverse manufacturing industries for counting products or other objects, in addition to their use in the forest industry. One example of the many different areas of use of such devices is the counting of migratory birds.

These known counting devices are mechanical and require a counter mechanism for each object whose numbers are to be counted and recorded. Since the counting device is mechanical, the cost of the counter mechanism is relatively high. Furthermore, mechanical counting devices are heavy and clumsy to carry. It is often necessary to count the numbers of various different objects, such as when making inventories in forests and wooded areas. This means that several counting devices must be carried when making such diverse inventories.

The present invention solves the problems associated with known counting devices.

SUMMARY OF THE INVENTION

The present invention thus relates to a hand-carried counting device in which a counter is stepped forwards through one increment in response to the depression of a count key or button. The counter is electronic and includes at least three different count keys for counting the respective numbers of three different objects. Depressing a key causes an electric signal to be sent to a register in a microprocessor or the like that is included in the counting device. The register corresponds with the key that has been depressed. The counting device includes a function key which when pressed once or a repeated number of times causes the microprocessor to perform at least the function of displaying on a counter display certain current, i.e. prevailing, count values relating to the different registers.

BRIEF DESCRIPTION OF THE DRAWINGS

The invention will now be described in more detail with reference to an exemplifying embodiment thereof and also with reference to the accompanying drawing, in which.

DESCRIPTION OF THE PREFERRED EMBODIMENTS

Figure 1:
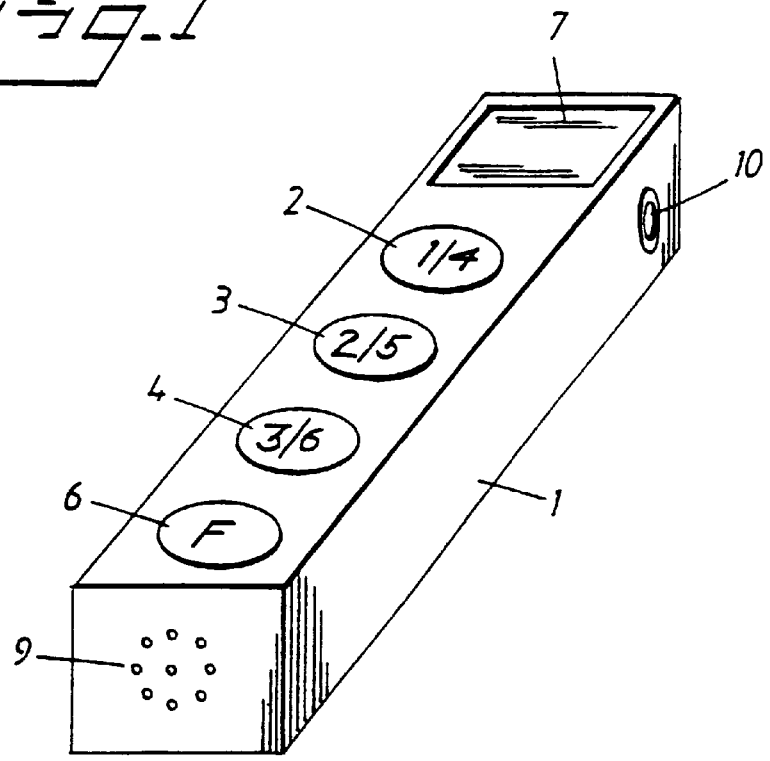
FIG. 1 is a perspective view of a counting device in accordance with the present invention.

FIG. 1 illustrates a hand carried counting device 1 in accordance with the present invention. Counting device 1 includes count keys or buttons 2–4. A counter is stepped forwards through one increment each time a key is pressed.

Figure 2:
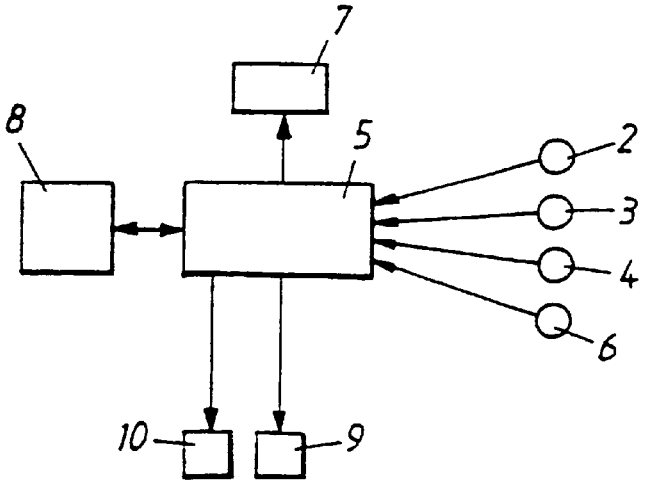
FIG. 2 is a schematic block diagram of the counter shown in FIG. 1.

The inventive counting device 1 is electronic and includes at least three different count keys 2–4 for counting the respective numbers of three different objects. Depression of a key causes an electric signal to be sent to a register in a count microprocessor 5 (see FIG. 2) or like means in the device 1, said register corresponding with the key that has been depressed. The device also includes a function key 6 which, when pressed once or when pressed repeatedly, causes the microprocessor 5 to perform at least the function of displaying current count values of the different registers on a display 7 included in the device 1. The microprocessor 5 is connected to a RAM memory 8 in which the registers and software are stored.

According to one preferred embodiment of the invention, at least one count key 2–4 is related to two count registers. In this case, the microprocessor 5 is adapted to step forwards one count register through one increment when only one of the keys 2–4 is pressed, and to step forward the second count register through one increment when one of count keys 2–4 and the function key 6 are depressed. For instance, if only the key 3 is depressed, count register number two counts forwards one increment. On the other hand, if both the function key and the key 3 are depressed simultaneously, count register number five counts forwards one increment.

According to another preferred embodiment, the counting device includes a loudspeaker 9 which is controlled by the microprocessor 5 to emit different acoustic signals in response to depression of the various keys. This assists in ensuring that the correct key has been depressed, in respect of the object being counted at that time.

The counting device 1 is powered by an electric battery (not shown) which is preferably housed within the device. The microprocessor 5 may be designed to sense the battery voltage and to deliver a separate acoustic signal, via the loudspeaker 9, when the battery voltage has fallen below a given predetermined level.

According to one highly preferred embodiment of the invention, the microprocessor 5 is designed to step forward between different functions and to display the function concerned on the display 7, in response to repeated depressions of the function key 6.

It is also preferred that when depressing a key 2–4, a function causes the register in question to be stepped backwards through one increment.

According to another preferred embodiment, the counting device includes a data output terminal 10 by means of which the device 1 can be connected to a computer (not shown) for delivering the information contained in the different registers contained in RAM memory 8 of the device.

It will be apparent that the present invention provides a light and convenient counting device that includes several different count registers that can be used smoothly while shifting from one register to another. It will also be evident that the drawbacks and disadvantages associated with known counting devices and described in the introduction have been eliminated by the present invention.

Although the invention has been described above with reference to a number of exemplifying embodiments, it will be understood that modifications can be made. For instance, the device may include more count keys than those shown, and may also include two or more function keys.

The invention is therefore not restricted to said embodiments, since modifications and variations can be made within the scope of the following Claims.

What is claimed is:

1. A hand-carried, electronic counting device in which one depression of a count key or button carried by the device causes a counter to step forwards through one increment, said counting device comprising: at least three different count keys carried by the device for counting three mutually different objects, each key operatively coupled with a respective count register associated with a microprocessor within said device; a display carried by the device and coupled with the microprocessor; a function key carried by the device and which when depressed causes the microprocessor to perform at least a function that causes count values in the various registers to be shown on the display; and wherein at least one count key is operatively coupled with each of two count registers that are not coupled with another count key.

2. A counting device according to claim 1, wherein one of said two count registers is stepped up through one increment in response to the depression of its associated count key and the other of the two count registers is stepped up through one increment in response to simultaneous depression of the associated count key and the function key.

3. A counting device according to claim 1, wherein the device includes a loudspeaker coupled with the microprocessor to emit different acoustic signals in response to the depression of different keys carried by the device.

4. A counting device according to claim 1, wherein the device includes a data output terminal for connecting said device to a computer for delivering to the computer information contained in a count register of said device.

5. A counting device according to claim 1, wherein the microprocessor is adapted to step forward between different functions in response to repeated depression of the function key to show on the display the function selected.

6. A counting device according to claim 5, wherein one selectable function corresponds to backward stepping of a register through one increment in response to depression of a corresponding count key.

7. A counting device according to claim 1, wherein one of said two count registers is stepped up through one increment in response to the depression of its associated count key and the other of the two count registers is stepped up through one increment in response to depression of the associated count key and the function key.

* * * * *